US007814945B2

(12) United States Patent
Babcock

(10) Patent No.: US 7,814,945 B2
(45) Date of Patent: Oct. 19, 2010

(54) COMPACT LOG SPLITTER

(75) Inventor: Stephen Emerson Babcock, Lakeville, MN (US)

(73) Assignee: Northern Tool & Equipment Company, Inc., Burnsville, MN (US)

( * ) Notice: Subject to any disclaimer, the term of this patent is extended or adjusted under 35 U.S.C. 154(b) by 79 days.

(21) Appl. No.: 12/047,374

(22) Filed: Mar. 13, 2008

(65) Prior Publication Data

US 2009/0229709 A1 Sep. 17, 2009

(51) Int. Cl.
*B27L 7/00* (2006.01)
*B27L 7/02* (2006.01)

(52) U.S. Cl. ..... 144/4.6; 144/193.2; 144/195.1; 144/195.8

(58) Field of Classification Search ..... 144/4.6, 144/193.2, 195.1, 195.8, 193.1
See application file for complete search history.

(56) References Cited

U.S. PATENT DOCUMENTS

| | | | | | |
|---|---|---|---|---|---|
| 3,319,675 | A | * | 5/1967 | Bles, Sr. | 144/193.1 |
| 4,103,724 | A | | 8/1978 | Braid | |
| 4,258,765 | A | * | 3/1981 | Suomi | 144/195.1 |
| 4,351,377 | A | * | 9/1982 | Hamel | 144/195.1 |
| 4,366,848 | A | * | 1/1983 | Gavinski | 144/195.1 |
| 4,378,038 | A | | 3/1983 | Doiron et al. | |
| 4,470,441 | A | * | 9/1984 | Wirsbinski et al. | 144/195.1 |
| 4,498,293 | A | * | 2/1985 | Gregory | 60/478 |
| 4,522,241 | A | | 6/1985 | West | |
| 4,679,607 | A | * | 7/1987 | Bradley | 144/195.1 |
| 4,782,870 | A | | 11/1988 | Duerr | |
| 5,526,855 | A | | 6/1996 | Graham | |
| 6,076,576 | A | * | 6/2000 | Maddox et al. | 144/195.1 |
| 7,255,143 | B1 | | 8/2007 | Babcock et al. | |
| 2005/0284540 | A1 | | 12/2005 | Walker et al. | |
| 2006/0144468 | A1 | | 7/2006 | Lewis et al. | |
| 2007/0000975 | A1 | | 1/2007 | Paradise | |

* cited by examiner

*Primary Examiner*—Shelley Self
(74) *Attorney, Agent, or Firm*—Patterson Thuente Christensen Pedersen , P.A.

(57) ABSTRACT

A log splitter comprises a support structure having a first end, a second end, and an open center portion defined therebetweeen, a splitting device slidably coupled to the support structure, and a drive mechanism for driving movement of the splitting device through a splitting zone. The splitting device comprises an elongate beam having an outer surface, a first end, a second end, and an open center portion between the first end and the second end, and a splitting wedge coupled to the outer surface of the elongate beam and having at least one splitting surface formed thereon. The elongate beam is disposed within the open center portion of the support structure. The drive mechanism is disposed within the open center portion of the elongate beam, and is coupled on a first end to the first end of the support structure and on a second end to the second end of the elongate beam.

14 Claims, 8 Drawing Sheets

COMPACT LOG SPLITTER

BACKGROUND OF THE INVENTION

The present invention relates in general to a log splitter. More particularly, the present invention relates to a compact log splitter having a splitting wedge coupled to a beam, where the beam has a drive mechanism disposed therein.

Log splitting devices have been in use for decades. Conventional log splitters typically include a stationary support frame configured to support a hydraulic cylinder and a cooperating splitting wedge. Generally speaking, splitting of wood occurs by causing the splitting wedge to be forced through the wood, using the force of the hydraulic cylinder. In a fixed wedge version, the splitting wedge is fixed to the supporting frame, and the log is forced into the splitting wedge. In use, a log is placed in the appropriate position and is forcibly pushed against the stationary splitting wedge by the force created when the hydraulic cylinder is extended. Obviously, this requires movement or sliding of the log in order to create the desired split. This required movement necessarily requires that this type of splitter be positioned in a horizontal manner to allow space for the log to move past the wedge. In an alternative version, the splitting wedge is attached to the hydraulic cylinder, which is typically attached to the support frame. In this type of design, the log is held in place by some type of stop, thus allowing the force of the hydraulic cylinder to force the splitting wedge through the log.

As those skilled in the art will appreciate, large amounts of hydraulic force make it easier to split logs with a log splitter. This is true in both fixed and movable splitting wedge designs. However, as the amount of hydraulic force supplied by the hydraulic cylinder increases, so does the required strength of the log splitter components. For example, large amounts of hydraulic force require that the support frame, splitting wedge, and stop member be constructed with sufficient strength to counteract the hydraulic force without breaking or otherwise becoming deformed.

Log splitters may also be broken into two categories based upon their orientation during operation—horizontal splitters and vertical splitters. Generally speaking, horizontal splitters require logs to be positioned horizontal and roughly parallel to the surface on which the log splitting device is set. Horizontal splitters work well for smaller, lighter logs. However, horizontal splitters can be inconvenient to use when splitting large, heavy pieces of wood. Operators must lift heavy and irregular shaped logs in order to position them in horizontal splitters. This creates safety hazards to operators as well as inefficiencies in the splitting process. All fixed wedge splitters are required to operate in the horizontal orientation, to allow space for the log to exit past the wedge itself.

Current horizontal-type log splitter designs are often large and bulky, making them difficult to both transport and store when not in use. The configuration of the log splitters themselves has traditionally dictated size requirements. In both the fixed wedge and movable wedge versions, a predetermined "splitting zone" is required to have a certain length. Naturally, the cylinder must be positioned to accommodate travel through the splitting zone. The length of the splitting zone and the length of the cylinder, when added together, require the splitter to be quite long, thus being difficult to handle. In addition, post-manufacture shipment of these log splitters to retail locations and the like is inconvenient and expensive due to their size and shape. For example, most current horizontal-type log splitters are too large to be shipped on a standard size pallet. Thus, compact log splitters that are sized to fit on a standard pallet during shipping would be highly desirable.

As mentioned above, one common design element that has made these log splitters large and bulky is the coupling of the splitting wedge or pusher in series with a hydraulic cylinder. As a result, the log splitter must be designed with a support structure having a longitudinal length that is sufficient to account for both the longitudinal length of the hydraulic cylinder used to drive the splitting wedge or pusher, as well as the longitudinal length of travel of the splitting wedge (i.e., the length of the "splitting zone"). Due to strength requirements, this support structure is continuous (e.g., a single continuous I-Beam support). Thus, while this type of design is efficient in that movement of the hydraulic piston within the cylinder transmits directly to the splitting wedge because of their positioning in series with one another and in substantially the same horizontal plane, the overall size of the log splitter is greatly increased.

Based on the foregoing, there exists a need for a compact log splitter that is compact in size to enable the log splitter to be easily shipped, transported and stored when not in use. In addition, there is a need for a compact log splitter capable of splitting logs similar in size to those that may be split using much larger log splitters.

BRIEF SUMMARY OF THE INVENTION

The present invention solves the foregoing problems by providing a log splitter comprising a support structure having a first end, a second end, and an open center portion defined therebetweeen, a splitting device slidably coupled to the support structure, and a drive mechanism for driving movement of the splitting device through a splitting zone. The splitting device comprises an elongate beam having an outer surface, a first end, a second end, and an open center portion between the first end and the second end, and a splitting wedge coupled to the outer surface of the elongate beam and having at least one splitting surface formed thereon. The elongate beam is disposed within the open center portion of the support structure. The drive mechanism is disposed within the open center portion of the elongate beam, and is coupled on a first end to the first end of the support structure and on a second end to the second end of the elongate beam.

Due to the nested structure of the splitting device, the size of the splitter is minimized because the support structure does not have to be designed with a longitudinal length that is sufficient to account for both the longitudinal length of the drive mechanism and the longitudinal length of travel of the splitting wedge.

DETAILED DESCRIPTION OF THE INVENTION

Figure 1:
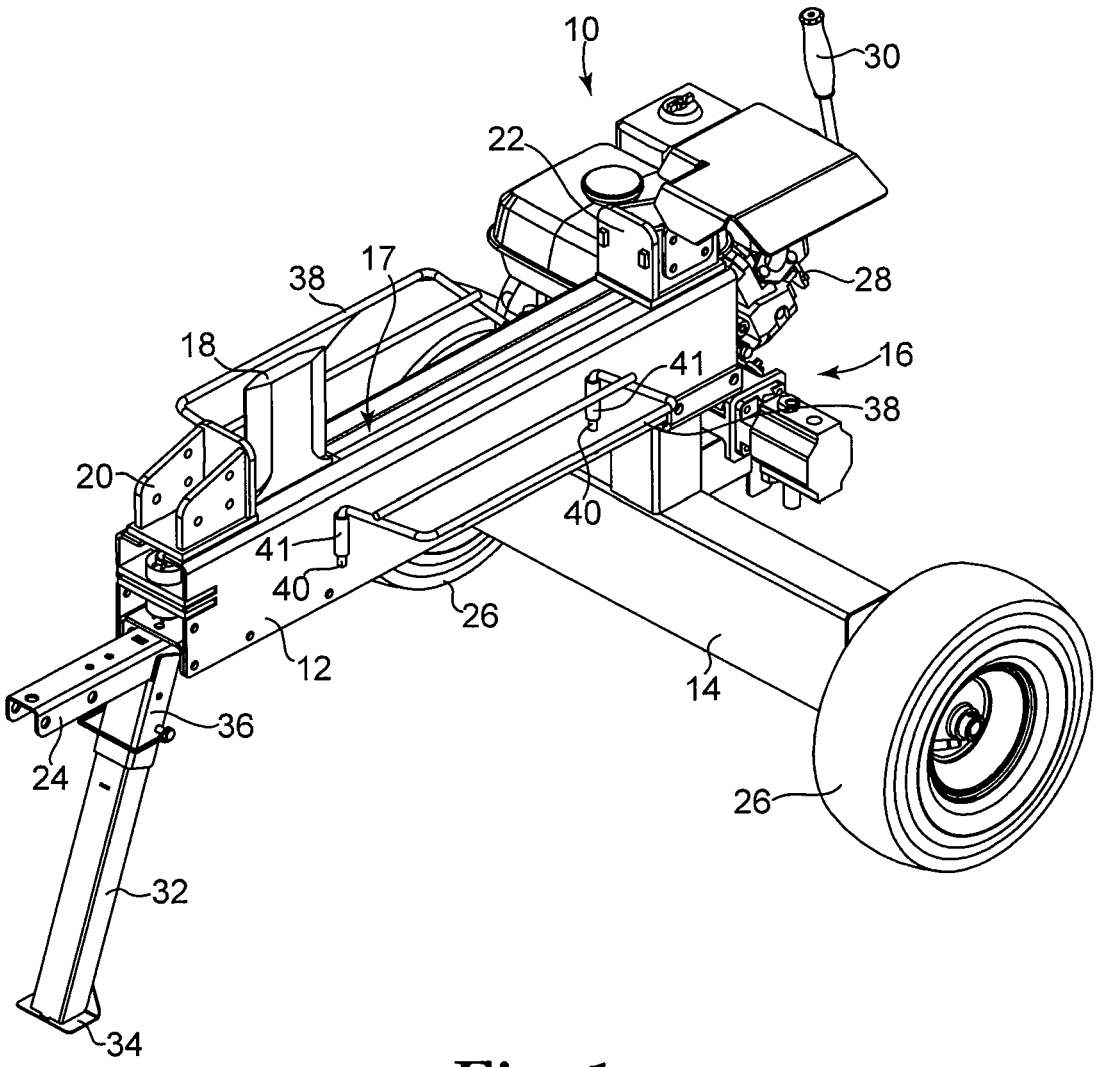
FIG. 1 is a perspective view of a log splitter in accordance with the present invention.

FIG. 1 is a perspective view of a log splitter 10 in accordance with the present invention. As shown in FIG. 1, log splitter 10 includes support structure 12, wheel base 14, drive system 16 connected to support framework 12 and wheel base 14, a splitting device 17 having a splitting wedge 18 operably coupled to drive system 16, first stop member 20, and second stop member 22. Log splitter 10 shown in FIG. 1 is a trailer-type log splitter having hitch 24 and wheels 26 in order to couple log splitter 10 to a transport vehicle, allowing the splitter to be moved from location to location. Alternatively, those skilled in the art will appreciate that log splitter 10 may be stationary, variable in size and/or designed to be disassembled into smaller components for transportation, storage, etc., and reassembled when necessary for use.

Drive system 16 includes pump and motor assembly 28, control handle 30, a control valve (not shown), and a hydraulic cylinder or drive mechanism (not shown). Pump and motor assembly 28 of drive system 16 is coupled to wheel base 14, while the drive mechanism may be coupled to support framework 12 as will be discussed in more detail to follow. The drive mechanism of drive system 16 is designed to drive splitting wedge 18 between first stop member 20 and second stop member 22 in order to split logs as will be appreciated by those skilled in the art. Control handle 30 is operably coupled to both pump and motor assembly 28 and the drive mechanism, and is structured to control movement of splitting wedge 18 via the drive mechanism. In particular, movement of control handle 30 causes corresponding adjustments in the control valve, which controls the flow of fluid into and out of the drive mechanism.

As shown in FIG. 1, log splitter 10 may optionally include support stand 32. Support stand 32 includes foot portion 34 on one end, and may be coupled to support structure 12 via a sleeve 36 or similar device on an opposing end. Support stand 32 may be extended while log splitter 10 is being operated to split logs or being stored such that foot portion 34 rests on a substantially flat surface. In one embodiment, sleeve 36 may be coupled to support structure 12 with a hinge or similar device that allows support stand 32 to be rotated or "kicked" out of the way when not in use. In an alternative embodiment, sleeve 36 may be fixedly coupled to support structure 12. In this embodiment, support stand 32 may simply be removed from sleeve 36 during, for example, transport of log splitter 10.

As shown in FIG. 1, log splitter 10 may also optionally include rack members 38 extending from each side of support structure 12. Rack members 38 may function to temporarily store logs that are about to be cut with splitting wedge 18 as well as to prevent log segments from falling from log splitter 10 after a log has been cut. In particular, each rack member 38 may be coupled to support structure 12 by positioning a pair of rack attachment members 40 into a corresponding pair of sleeves 41 coupled to the sides of support structure 12. However, one skilled in the art will appreciate that rack members 38 may be coupled to support structure 12 in any suitable way, such as by welding or bolting rack attachment members 40 to support structure 12.

Figure 2:
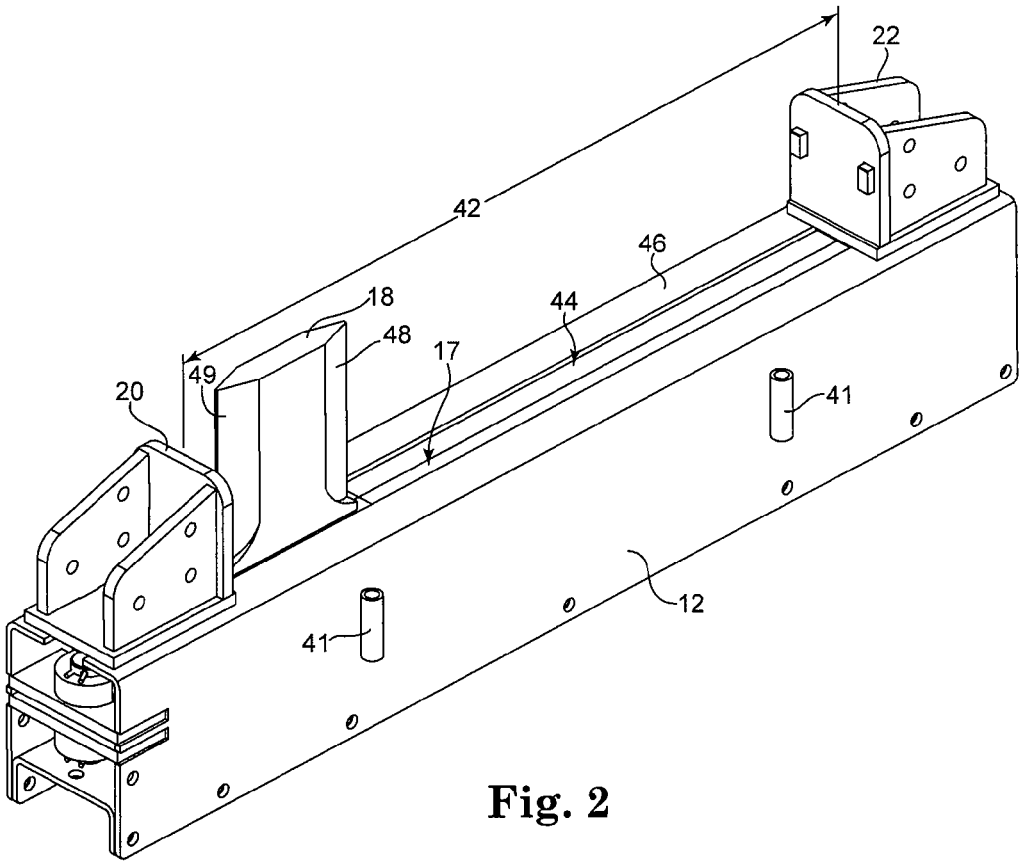
FIG. 2 is a perspective view of one section of the log splitter of FIG. 1.

FIG. 2 is a perspective view of a portion of log splitter 10 in accordance with the present invention. As shown in FIG. 2, the longitudinal distance between first stop member 20 and second stop member 22 defines a splitting zone 42. As will be discussed in more detail to follow, drive system 16 is structured to drive splitting wedge 18 through splitting zone 42 in order to split a log positioned therein.

As shown in FIG. 2, splitting wedge 18 extends into splitting zone 42 through a longitudinal channel 44 in an upper surface 46 of support structure 12. Splitting wedge 18 is a dual splitting wedge having first splitting surface 48 and second splitting surface 49. As a result, splitting wedge 18 is structured to split a first log with first splitting surface 48 while moving from a retracted position adjacent first stop member 20 to an extended position adjacent second stop member 22, and to split a second log with second splitting surface 49 while moving from the extended position adjacent second stop member 22 back toward the retracted position adjacent first stop member 20. As appreciated by those skilled in the art, this dual cutting action/ability is much more efficient and saves considerable amounts of time during operation.

Figure 3:
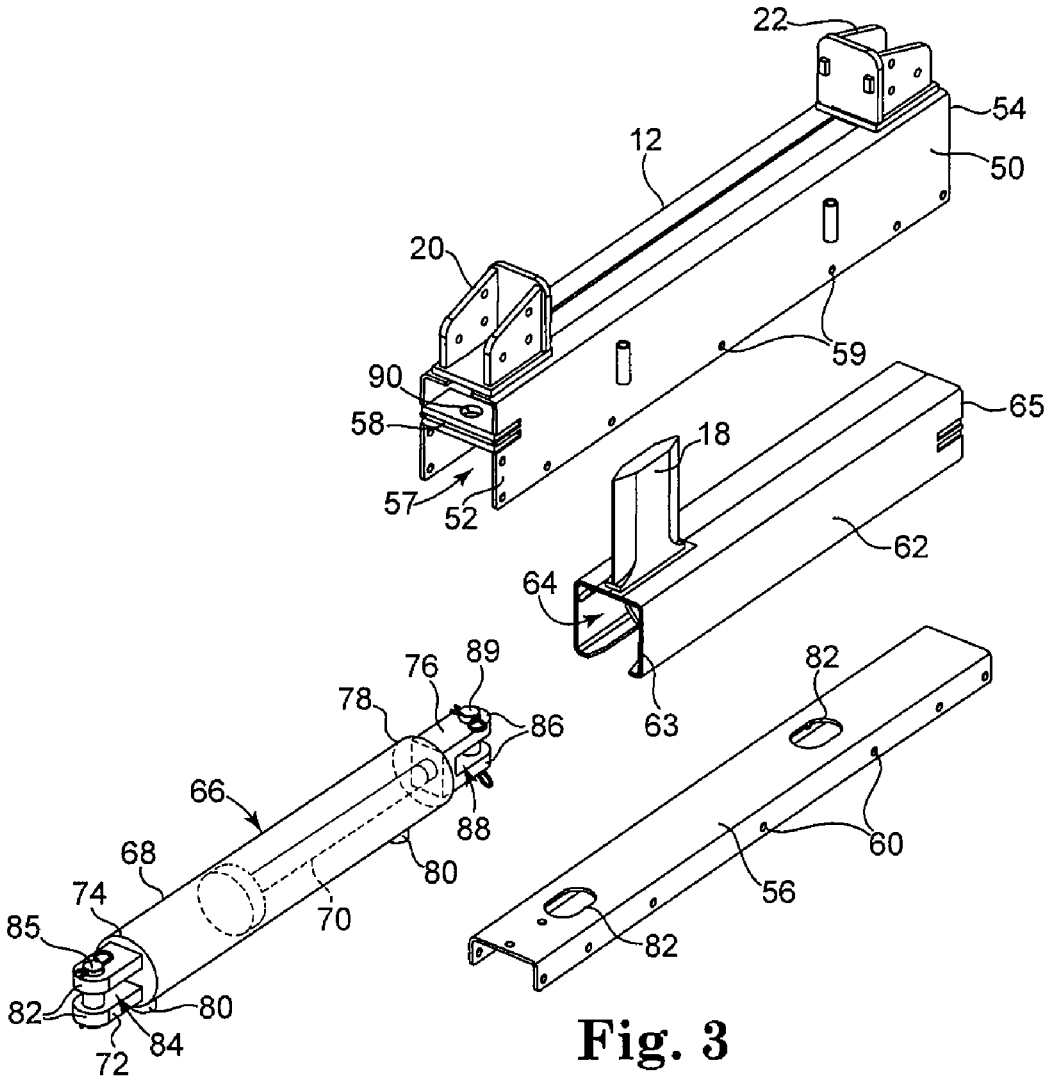
FIG. 3 is an exploded view of the portion of the log splitter illustrated in FIG. 2.

FIG. 3 is an exploded view of the portion of log splitter 10 illustrated in FIG. 2. As better shown in FIG. 3, support structure 12 includes top portion 50 having first end 52 and second end 54, and a base portion 56 attachable thereto. When assembled, these two components (i.e., top portion 50 and base portion 56) create an open center portion 57 defined therebetween. A support structure mount 58 is formed at first end 52 of top portion 50 to provide a mounting surface for a driving mechanism, as will be described in further detail to follow. Base portion 56 is structured to be mounted to top portion 50 via any suitable fastening means. In one embodiment, base portion 56 may be mounted to top portion 50 by inserting a plurality of fasteners through both a plurality of apertures 59 in top portion 50 and a corresponding plurality of apertures 60 in base portion 56.

As shown in FIG. 3, splitting device 17 includes the splitting wedge 18 previously described and an elongate beam 62. Splitting wedge 18 is arranged substantially perpendicular to the outer surface of elongate beam 62, and may be coupled to elongate beam 62 via any suitable means, such as by welding. That said, care must be taken to insure that the connection has sufficient strength to handle the loads being applied to splitting wedge 18. Elongate beam 62 includes a first end 63, an open center portion 64, and a second end 65. Elongate beam 62 is structured to receive drive mechanism 66, which forms a portion of drive system 16 previously described. In this embodiment, drive mechanism 66 is a fairly standard hydraulic cylinder which includes cylinder housing 68 and extendable member 70 disposed therein. Drive mechanism 66 further includes first attachment means 72 at first end 74, second attachment means 76 at second end 78, and a pair of hydraulic connecting posts 80.

First attachment means 72 includes a pair of plates 82 defining a slot 84 therebetween, and a pin member 85 structured for insertion between the pair of plates 82. Similarly, second attachment means 76 includes a pair of plates 86 defining a slot 88 therebetween, and a pin member 89 structured for insertion between the pair of plates 86.

When support structure 12, splitting device 17, and drive mechanism 66 are assembled as shown in FIG. 2, hydraulic connecting posts 80 of drive mechanism 66 extend through a longitudinal opening formed in the bottom of elongate beam 62 and into a corresponding pair of post receiving apertures 82 in bottom portion 56 of support structure 12. First attachment means 72 at first end 74 of drive mechanism 66 is then structured to mate with support structure mount 58 coupled to first end 52 of support structure 12 in order to fixedly couple drive mechanism 66 to support structure 12. In particular, slot 84 formed between the pair of plates 82 is structured to receive support structure mount 58. Pin member 85 is then inserted through a pin receiving aperture 90 in support structure mount 58 in order to fixedly couple drive mechanism 66 to support structure 12.

Although drive system 16 is described herein as including pump and motor assembly 28 and drive mechanism 66 comprising a cylinder housing 68 operably coupled to an extendable member 70, workers skilled in the art will appreciate that any type of drive mechanism may be used provided that it is capable of driving splitting wedge 18 horizontally through a log. Examples of alternative drive mechanisms include, but are not limited to, wheel drive mechanisms, screw or worm drives, and the like.

Figure 4:
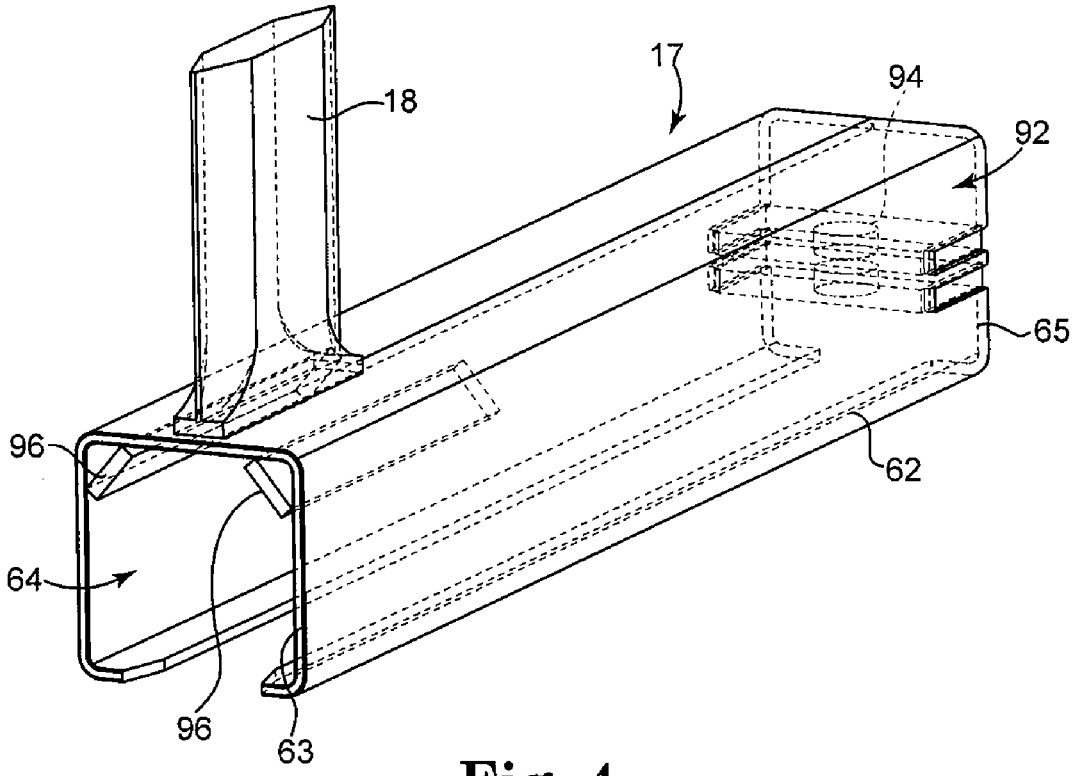
FIG. 4 is a perspective view of a splitting device in accordance with the present invention having a splitting wedge coupled to an elongate beam.

FIG. 4 is an enlarged perspective view of splitting device 17 shown and described above in reference to FIG. 3. As previously discussed, elongate beam 62 includes open center portion 64 sized to receive drive mechanism 66. Second end 65 of elongate beam 62 includes a splitting device mount 92 formed thereon. As shown in FIG. 4, splitting device mount 92 is positioned substantially perpendicular to the sides of elongate beam 62 and includes a pin receiving aperture 94 extending therethrough.

After positioning drive mechanism 66 within open center portion 64 of elongate beam 62, second attachment means 76 at second end 78 of drive mechanism 66 may be coupled to splitting device mount 92. In particular, splitting device mount 92 may be inserted into slot 88 formed between the pair of plates 86 of second attachment means 76. Pin member 89 may then be inserted through pin receiving aperture 94 in splitting device mount 92 in order to fixedly couple drive mechanism 66 to elongate beam 62. Once coupled together, drive mechanism 66 may control longitudinal movement of elongate beam 62 of splitting device 17, and thus, movement of splitting wedge 18 through splitting zone 42.

As shown in FIG. 4, elongate beam 62 may optionally include bracket members 96 coupled to one or more of the interior corners within open center portion 64 of the beam. Bracket members 96 may function to, for example, provide additional structural support in order to prevent deformation of elongate beam 62 as a result of various forces acting on splitting wedge 18 and beam 62.

Although first and second attachment means 72 and 76 have previously been described as utilizing a pin to secure the attachment means to respective mount members, workers skilled in the art will appreciate that any suitable fastening means may be used. Thus, pin members are shown merely for purposes of example and not for limitation.

Figure 5A:
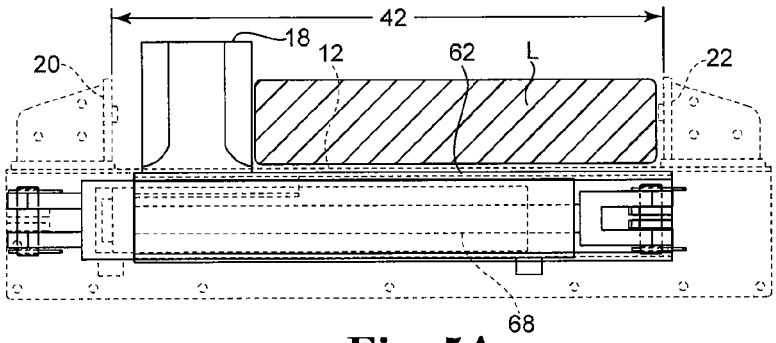
FIGS. 5A and 5B are diagrams illustrating movement of the splitting wedge of FIG. 4 through a splitting zone of the log splitter.
Figure 5B:
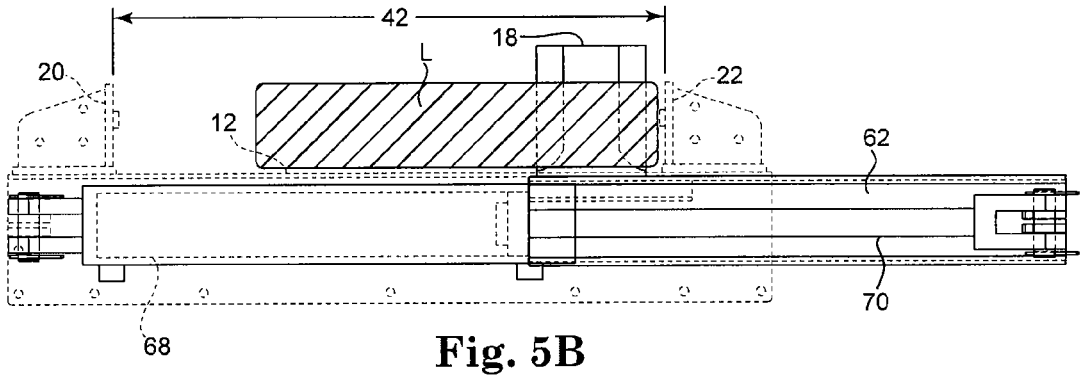

FIGS. 5A and 5B are diagrams illustrating movement of splitting wedge 18 through splitting zone 42. In particular, FIG. 5A illustrates splitting wedge 18 in the retracted position, while FIG. 5B illustrates splitting wedge 18 in the extended position. In the retracted position of FIG. 5A, extendable member 70 of drive mechanism 66 is retracted within cylinder housing 68, and splitting wedge 18 remains disposed adjacent first stop member 20. However, when extendable member 70 is actuated such that it extends out from cylinder housing 68 as illustrated in FIG. 5B, splitting wedge 18 is driven through splitting zone 42 to the extended position, thereby splitting log L positioned in splitting zone 42. In the extended position, splitting wedge 18 is disposed adjacent second stop member 22.

In embodiments of the present invention wherein splitting wedge 18 is a dual sided splitting wedge, an operator may split a second log when driving splitting wedge 18 from the extended position shown in FIG. 5B back to the retracted position shown in FIG. 5A. However, in embodiments that include a splitting wedge with a single splitting surface structured to split a log only when being driven between the retracted and extended positions, the operator must actuate the splitting wedge from the extended position back to the retracted position prior to splitting a second log.

The longitudinal length of movement of extendable member 70 between the retracted wedge position and extended wedge position is defined as the stroke length. The stroke length may be, for example, between 16 inches and 24 inches. However, workers skilled in the art will appreciate that the required stroke length will be selected based upon the desired length of splitting zone 42.

Figure 6A:
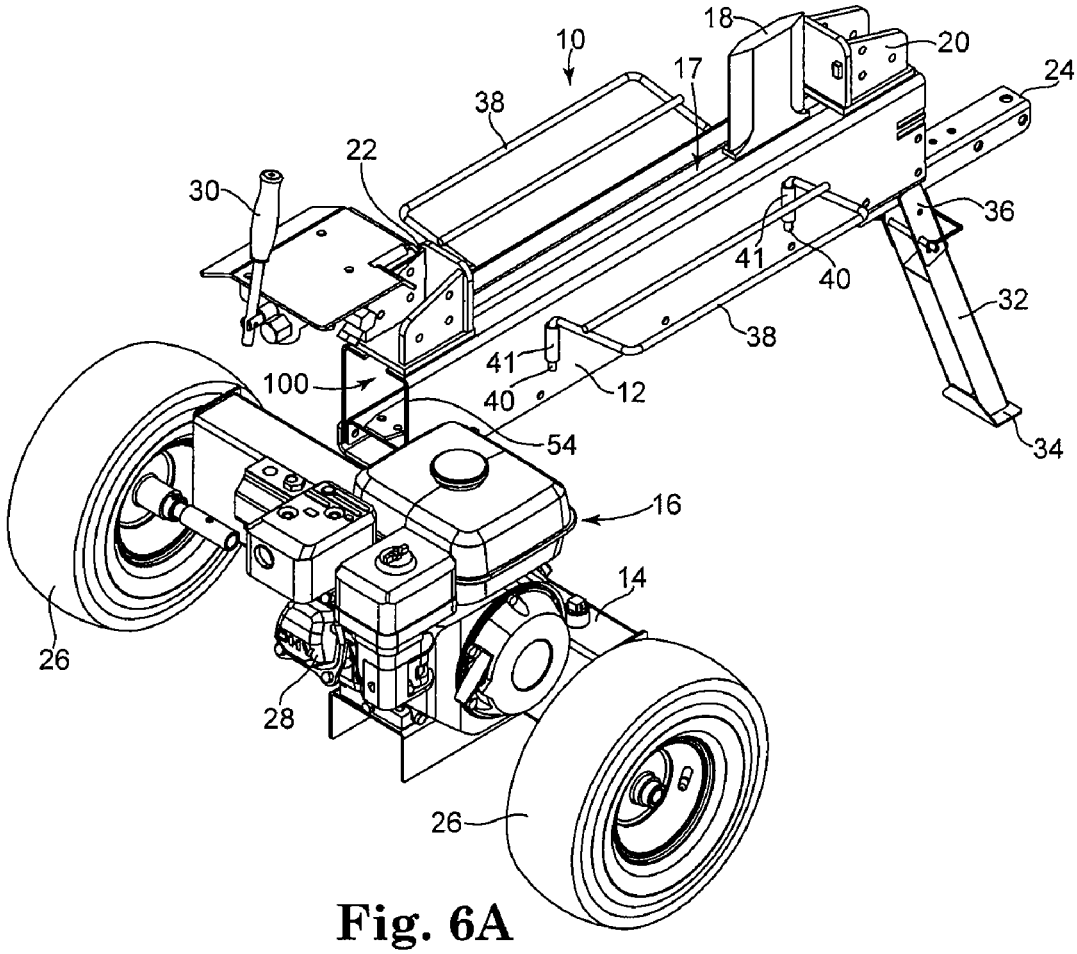
FIGS. 6A and 6B are perspective views of the log splitter of FIG. 1 showing the splitting wedge in the retracted and extended positions, respectively.
Figure 6B:
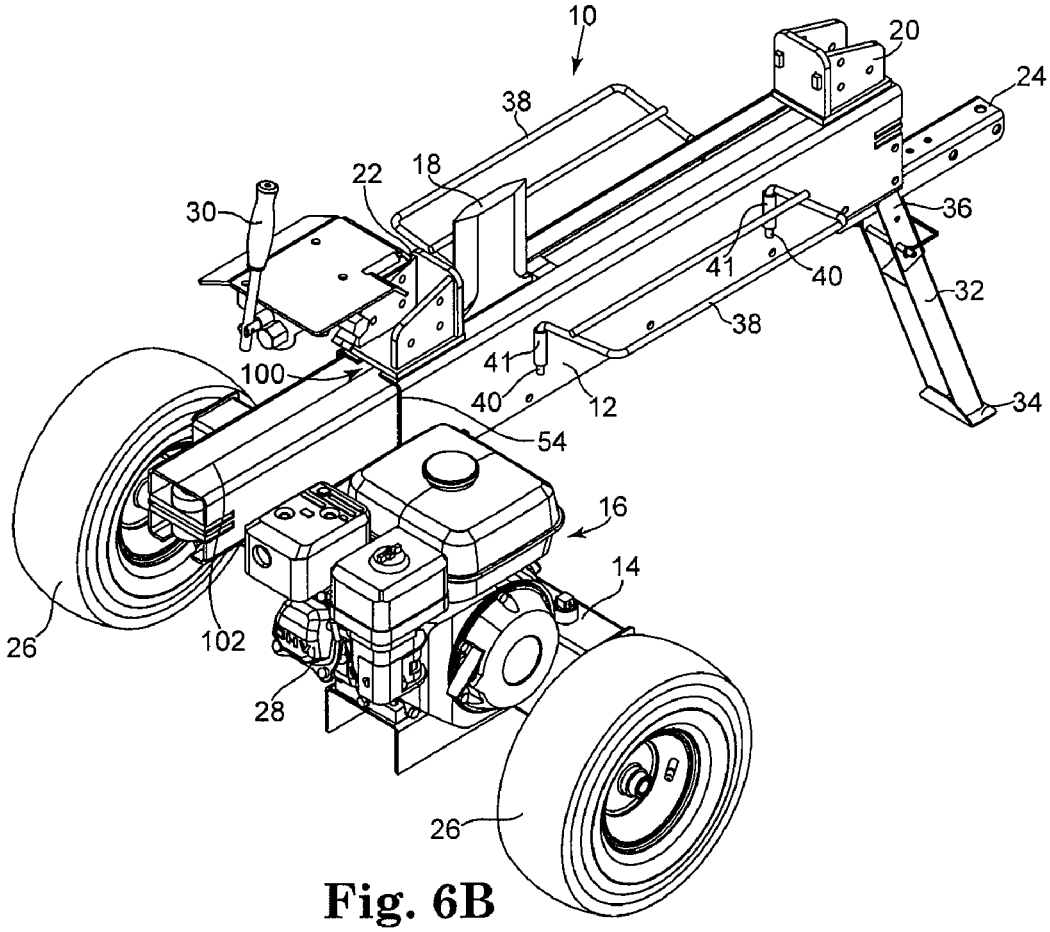

FIGS. 6A and 6B are perspective views of log splitter 10 illustrating the movement of splitting wedge 18 described above in reference to FIGS. 5A and 5B. In particular, FIG. 6A shows splitting wedge 18 in the retracted position adjacent first stop member 20, while FIG. 6B shows splitting wedge 18 in the extended position adjacent second stop member 22.

As shown in FIG. 6A, when splitting wedge 18 is in the retracted position, elongate beam 62, which is coupled to splitting wedge 18, is disposed within open center portion 57 of the support structure top portion 50. Furthermore, as shown in FIG. 6A, second end 54 of support structure 12 includes an opening 100 structured to allow elongate beam 62 of splitting device 17 to extend therethrough. In particular, when splitting wedge 18 is driven by drive system 16 to the extended position as shown in FIG. 6B, elongate beam 62 is correspondingly driven longitudinally such that a portion 102 of elongate beam 62 extends through opening 100 in second end 54 of support structure 12.

Designing log splitter 10 with drive mechanism 66 nested within elongate beam 62 and elongate beam 62 extendable through opening 100 in top portion 50 of support structure 12 during the log splitting process provides numerous advantages. One advantage of nesting drive mechanism 66 within elongate beam 62 is reducing the required longitudinal length of support structure 12. In conventional log splitter designs, the drive mechanism and splitting wedge were positioned in series and in substantially the same horizontal plane. Thus, the support structure had to be of sufficient length to account for both the length of the drive mechanism as well as the length of travel of the splitting wedge. By nesting the drive mechanism within an elongate beam member coupled to a splitting wedge, the drive mechanism and splitting wedge are now parallel to one another rather than in series with one another, thereby greatly reducing the required longitudinal length of the support structure of the log splitter. Another advantage of log splitter 10 that helps to reduce the required longitudinal length of support structure 12 is the opening 100 in second end 54 of top portion 50. Opening 100 in top portion 50 of support structure 12 allows elongate beam 62 to extend therethrough while driving splitting wedge 18 through splitting zone 42 between first stop member 20 and second stop member 22. As a result, the length of support structure 12 may be minimized because it is not necessary for support structure 12 to "house" the elongate beam during the entire log splitting process. Numerous other advantages may be realized by the design of log splitter 10 as will be appreciated by those skilled in the art.

Figure 7:
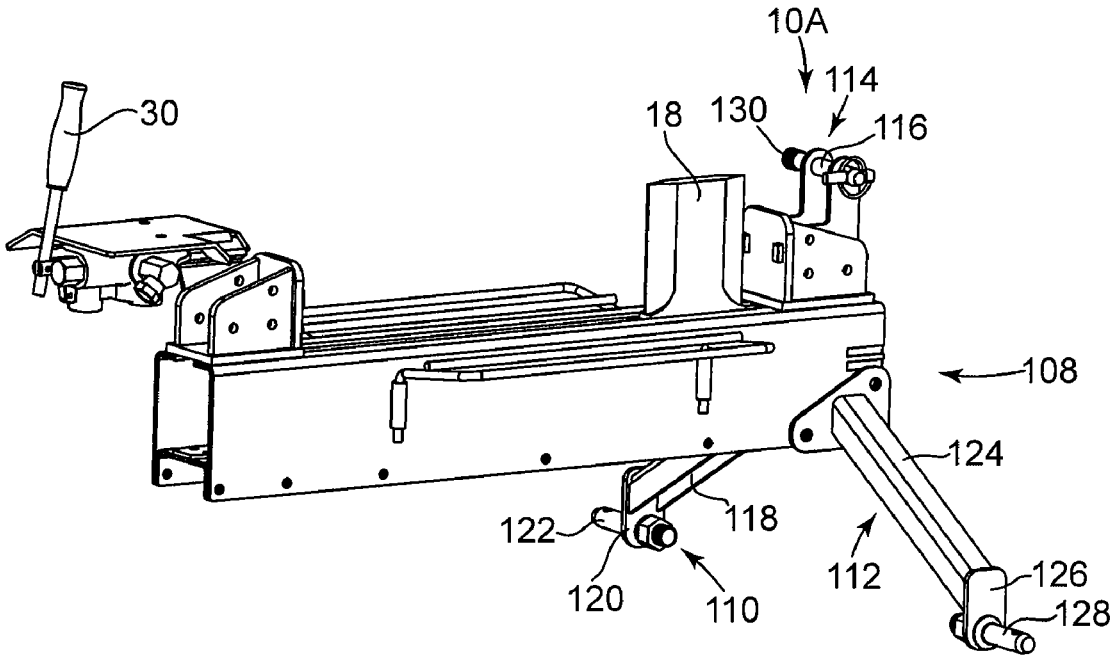
FIG. 7 is a second alternative embodiment of a compact log splitter in accordance with the present invention that is structured to be mounted to a three point hitch.

FIG. 7 is a perspective view of log splitter 10A, which is a first alternative embodiment of a compact log splitter in accordance with the present invention. More particularly, unlike log splitter 10 which is designed to be pulled behind a vehicle via hitch 24 and wheels 26, log splitter 10A is designed to be mounted directly to a vehicle. As shown in FIG. 7, log splitter 10A includes a three point mounting system 108 comprising first lower hitch assembly 110, second lower hitch assembly 112, and a pair of mast mounting plates 114 defining a slot 116 therebetween. First lower hitch assembly 110 includes first angled lower hitch bar 118, first lower hitch stud plate 120, and first stud member 122. Similarly, second lower hitch assembly 112 includes second angled lower hitch bar 124, second lower hitch stud plate 126, and second stud member 128. A locking pin 130 is structured for insertion through an aperture in the pair of mast mounting plates 114, as illustrated in FIG. 7.

Although log splitter 10A may be structured for mounting to numerous types of vehicles or heavy machinery, the log splitter may be particularly suited for attachment to a tractor. Tractors typically include a three point hitch, which is mounted to the back end of the tractor near the rear wheels. A three point hitch generally includes a pair of hitch lifting arms, which may be coupled to the hydraulic system of the tractor, and a center arm known as a top link. In order to mount log splitter 10A to the three point hitch, first stud 122 of first lower hitch plate 120 is inserted into an aperture in the first hitch lifting arm, second stud 128 of second lower hitch plate 126 is inserted into an aperture in the second hitch lifting arm, and the top link is positioned within slot 116 between the pair of mast mounting plates 114 and secured therein with pin member 130. Workers skilled in the art will appreciate that three point mounting system 108 represents only one example of a three point mounting system in accordance with the present invention. Thus, various modifications of three point mounting system 108 are contemplated and within the intended scope of the present invention.

Similar to log splitter 10, log splitter 10A also includes a control handle 30 and control valve (not shown) structured to control movement of splitting wedge 18. In particular, control handle 30 and the control valve may be operably coupled to the hydraulic system of the tractor such that movement of control handle 30 causes corresponding adjustments in the control valve, which controls the flow of fluid (from the hydraulic system of the tractor) into and out of the drive mechanism.

Although the embodiments described above focused on a log splitter having a hydraulically driven splitting wedge, those skilled in the art will appreciate that fixed wedge embodiments are also possible and within the intended scope of the present invention. In fixed wedge embodiments, the splitting wedge may be fixed to the support frame, such as support structure 12. A "stop member" or similar device having a log engaging surface may then replace the splitting wedge coupled to an elongate beam, and the stop member may be driven toward the splitting wedge by a drive mechanism such as the one previously described. Thus, those skilled in the art will appreciate that the inventive log splitter described herein may be adapted for use with both stationary and non-stationary splitting wedges.

Although the present invention has been described with reference to preferred embodiments, workers skilled in the art will recognize that changes may be made in form and detail without departing from the spirit and scope of the invention.

What is claimed is:

1. A splitting device for a log splitter comprising:

a support structure with a slot therein and at least one stop;

an elongate beam having an outer surface, a first end, and a second end, the elongate beam nestable beneath an outer surface of the support structure, wherein the elongate beam includes an open center portion between the first end and the second end, the elongate beam further comprising a mount member extending from the second end of the elongate beam and into the open center portion, wherein the mount member comprises one or more substantially flat plate members with a pin receiving aperture extending therethrough; and a splitting wedge coupled to the elongate beam near the first end, the splitting wedge arranged substantially perpendicular to the outer surface of the elongate beam and including at least one splitting surface formed thereon, the splitting wedge extending through the slot in the support structure.

2. The splitting device of claim 1, wherein the open center portion of the elongate beam is structured to receive a drive mechanism.

3. The splitting device of claim 1, further comprising one or more bracket members positioned within the open center portion of the elongate beam for providing structural support to the beam.

4. A log splitter comprising:

a support structure having a first end, a second end, and an open center portion defined therebetweeen, the support structure defining a slot;

a splitting device slidably coupled to the support structure, the splitting device comprising:

an elongate beam having an outer surface, a first end, a second end, an open center portion between the first end and the second end, wherein the elongate beam is disposed within the open center portion of the support structure, the elongate beam further comprising a mount member extending from the second end of the elongate beam and into the open center portion, the mount member comprising one or more substantially flat plate members with a pin receiving aperture extending therethrough; and a splitting wedge coupled to the outer surface of the elongate beam and extending through the slot in the support structure, the splitting edge including at least one splitting surface formed thereon; and a drive mechanism disposed within the open center portion of the elongate beam, the drive mechanism coupled on a first end to the first end of the support structure and on a second end to the second end of the elongate beam.

5. The log splitter of claim 4, wherein the drive mechanism is a hydraulic cylinder positioned within the elongate beam.

6. The log splitter of claim 4, further comprising a wheel assembly coupled to the support structure.

7. The log splitter of claim 6, further comprising a hitch member extending from the support structure.

8. The log splitter of claim 4, wherein the splitting wedge is a dual splitting wedge having first and second splitting surfaces.

9. The log splitter of claim 4, wherein the support structure further comprises a mount member extending from the first end of the support structure and into the open center portion of the structure.

10. The log splitter of claim 4, further comprising a pair of longitudinally spaced stop members coupled to the support structure and defining a splitting zone therebetween, the splitting wedge extending into the splitting zone.

11. The log splitter of claim 4, further comprising a three point mounting system coupled to the support structure and adapted for attachment to a three point hitch.

12. A log splitting system comprising:

a support structure having a first end, a second end, and an open center portion defined therebetweeen, the support structure defining an aperture;

a splitting device slidably coupled to the support structure, the splitting device comprising:

an elongate beam having an outer surface, a first end, a second end, and an open center portion between the first end and the second end, wherein the elongate beam is disposed within the open center portion of the support structure; and a splitting wedge coupled to the outer surface of the elongate beam, the splitting wedge including at least one splitting surface formed thereon, the splitting wedge extending through the aperture in the support structure;

a drive mechanism disposed within the open center portion of the elongate beam; and first and second longitudinally spaced stop members coupled to the support structure; wherein the drive mechanism is structured to drive the splitting device between a retracted position wherein the splitting wedge is positioned adjacent the first stop member and an extended position wherein the splitting wedge is positioned adjacent the second stop member and wherein a portion of the elongate beam extends through an opening in the second end of the support structure when the splitting device is driven to the extended position.

13. The log splitting system of claim 12, wherein the splitting wedge is a dual splitting wedge having first and second splitting surfaces.

14. The log splitting system of claim 12, wherein the drive mechanism comprises:

a hydraulic cylinder coupled to the first end of the support structure, wherein a piston of the hydraulic cylinder is extendable to drive the splitting device between the retracted position and the extended position.

* * * * *